United States Patent [19]

Lanham

[11] Patent Number: 5,016,816

[45] Date of Patent: May 21, 1991

[54] RESILIENT RAIL FASTENER

[75] Inventor: Mark E. Lanham, Kansas City, Mo.

[73] Assignee: Unit Rail Anchor Company, Hillside, Ill.

[21] Appl. No.: 465,345

[22] Filed: Jan. 16, 1990

[51] Int. Cl.[5] ..... E01B 9/00

[52] U.S. Cl. ..... 238/349; 238/351

[58] Field of Search ..... 238/315, 316, 317, 349, 238/351, 361; 411/522, 523, 524, 530, 352, 353

[56] References Cited

U.S. PATENT DOCUMENTS

| | | | |
|---|---|---|---|
| 3,144,909 | 8/1964 | Hart et al. | 411/530 |
| 3,640,460 | 2/1972 | Baseler | 238/349 |
| 3,799,437 | 3/1974 | Scherbaum | 238/349 |
| 3,881,652 | 5/1975 | Jacobson | 238/349 |
| 3,970,248 | 7/1976 | Molyneux | 238/349 |
| 4,625,912 | 12/1986 | Fee | 238/349 |

FOREIGN PATENT DOCUMENTS

| | | | |
|---|---|---|---|
| 2225220 | 2/1973 | Fed. Rep. of Germany | 238/349 |
| 2006308 | 5/1979 | United Kingdom | 238/349 |

*Primary Examiner*—Robert J. Spar
*Assistant Examiner*—Craig Slavin
*Attorney, Agent, or Firm*—Kinzer, Plyer, Dorn, McEachran & Jambor

[57] ABSTRACT

Resilient railroad fastener system comprising an elongated shoulder member and spring clip to be so applied and combined with the shoulder member as to create a toe load applied downward to the rail; the shoulder member having a reaction surface to be engaged at a first angle by one arm of the spring clip and the shoulder member being configured with a capturing surface to capture the other spring arm while cocking the spring clip at an angle to the horizontal when the spring clip is applied to the shoulder member; whereby when installed the spring clip has a toe load impressed thereon which is the vector sum of the clip load and shoulder reaction.

4 Claims, 2 Drawing Sheets

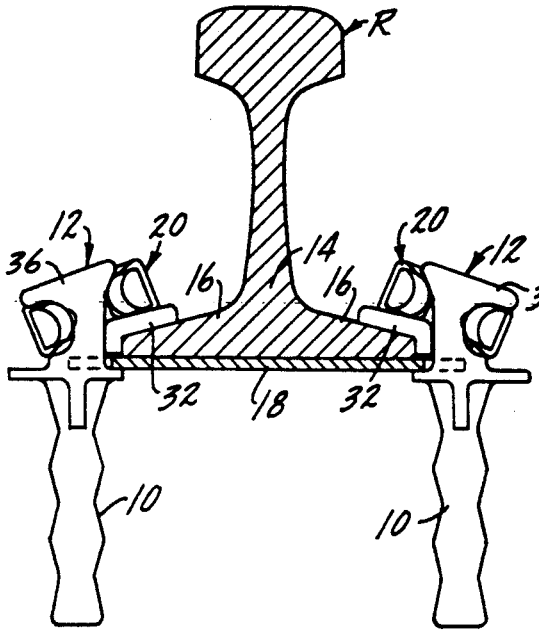
Fig. 1.
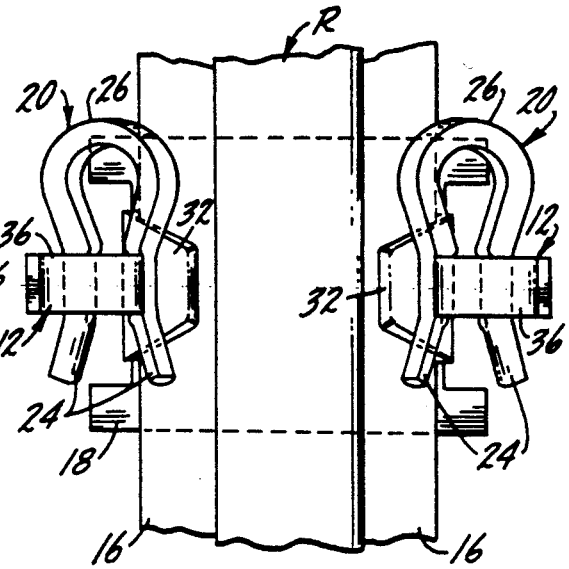
Fig. 2.
Fig. 3.
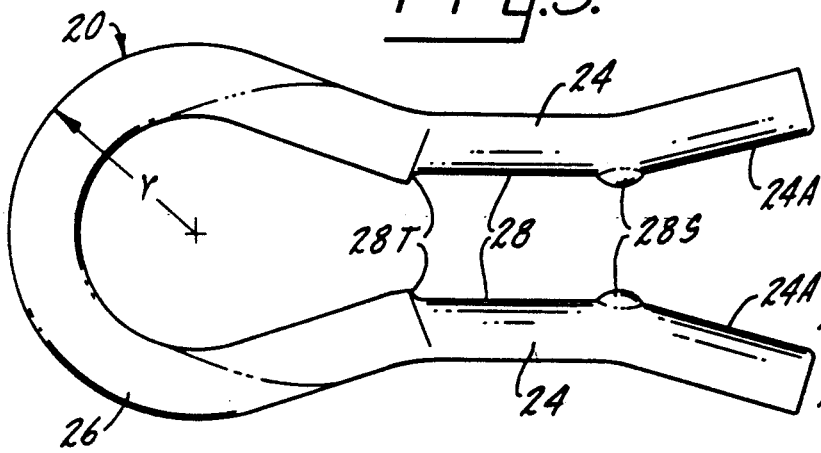
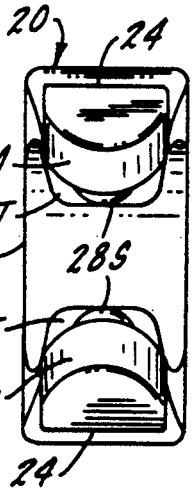
Fig. 5.
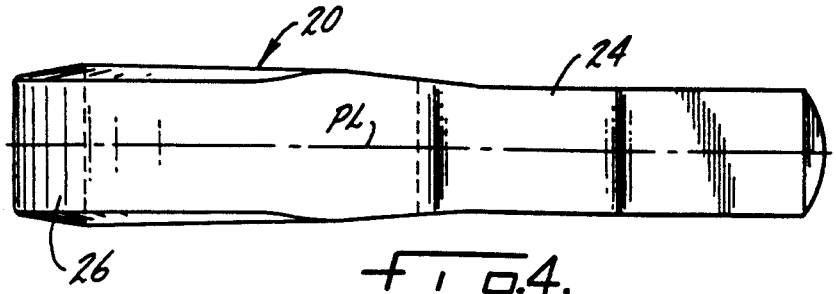
Fig. 4.

Fig. 6.
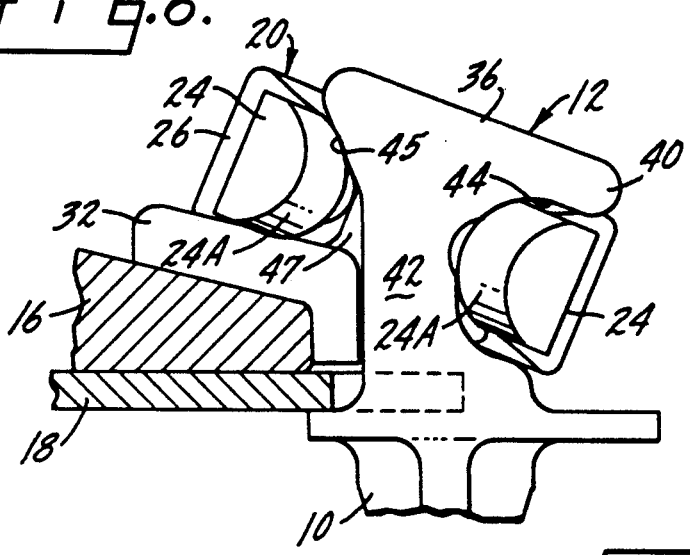
Fig. 7.
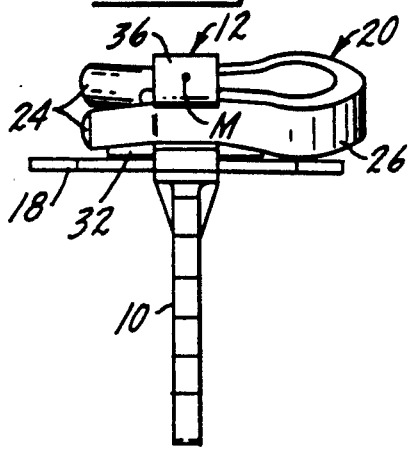
Fig. 6A.
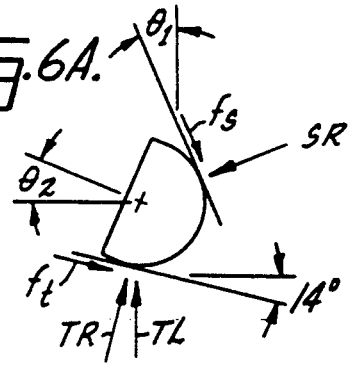
Fig. 8.
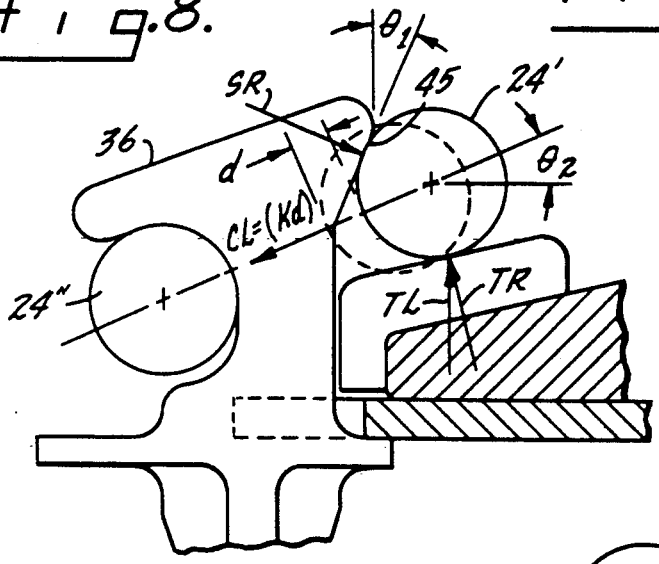
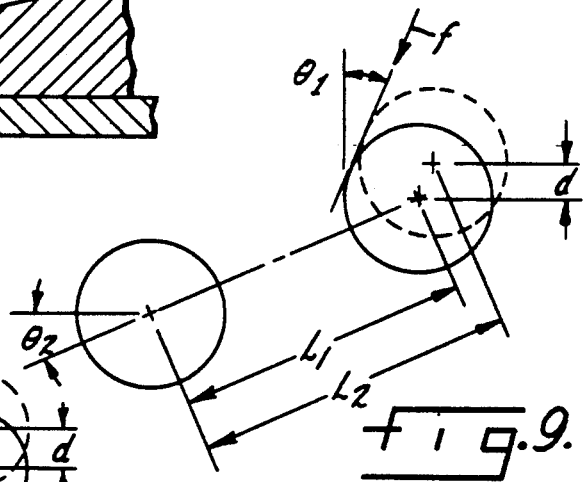
Fig. 9.
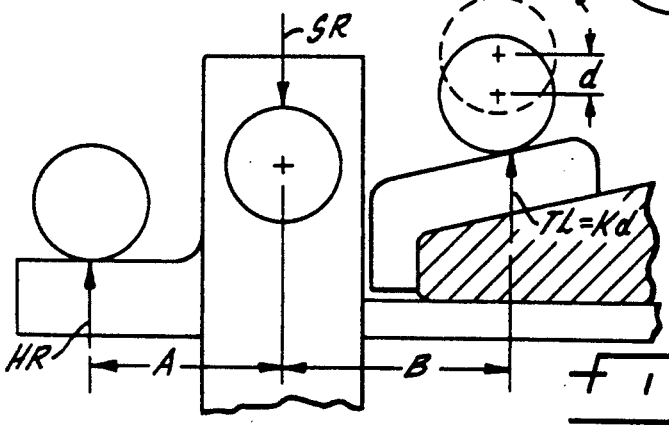
Fig. 10.
PRIOR ART

RESILIENT RAIL FASTENER

FIELD OF THE INVENTION

This invention relates to a resilient fastener for securing rails to cross ties. The cross tie may be either the typical wood tie or one of concrete.

BACKGROUND OF THE INVENTION

In railroads, the standard rail fastener, nearly from the beginning, has been the spike, driven into a wood tie on each side of the rail base to maintain gage. Tie plates have been employed which act as bearing pads against vertical forces and maintain the desired rail cant. Laterally spaced stops in the plate parallel to the rail line maintain gage. The tie plate is apertured to receive one or more spikes. Longitudinal restraint is provided by anticreeper devices attached to the bottom of the rail base on both sides of the tie. This time-honored arrangement is called a floating rail seat because there is no attempt to directly fix the rail to the tie; consequently, there is limited restriction to rail uplift or tipping. This is used for most rail installations today, but there are special cases as exceptions. One case is that of the concrete tie where spiking cannot be used and electrical insulation is needed because, unlike wood, the tie is not an insulator; therefore, conventional steel tie plates and anticreeper devices cannot be used. Another case occurs with severe railroad curves where the lateral thrust of the car wheels may be of such magnitude there is a possibility of the rail tipping to such an extent that derailment may occur.

Direct fixation fasteners have been used to prevent rail uplift and tipping. The earliest of these fasteners were stiff bolts tightened down on the rail base. These were prone to failure by pulling out of the tie or by fatigue because of their high stiffness. Resilient fasteners were introduced which had low stiffness so they could move with the rail but still maintain direct fixation. Direct fixation fasteners provide for longitudinal and lateral restraint replacing or augmenting spikes and anticreeper devices. In concrete tie applications, nonmetallic tie pads and insulators isolate the rail electrically.

Certain terms of art have been used in describing resilient fasteners. The clip is a spring which applies a hold-down force (toe load) to the rail base; the shoulder is a rigid chair or anchor member embedded in the cross tie, providing a rigid mount for the clip. All such devices heretofore constructed react the toe load by socketing action, producing an upward load on the shoulder (shoulder load) and a downward load (heel load) on a part of the shoulder termed the shelf. The arm of the clip which contacts the rail is thus cantilevered from the shoulder. In the present design, the toe load is produced by wedging one arm of the clip between the rail and shoulder rather than by cantilevering, therefore, no heel load is present.

BRIEF DESCRIPTION OF THE DRAWING

FIG. 1 is an end elevation of a pair of resilient rail fasteners in their home position, under the present invention;

FIG. 2 is a top plan view of FIG. 1;

FIGS. 3, 4 and 5 are plan, side and end elevation views of the spring clip featured under the present invention;

FIG. 6 is an enlarged detail partial end view of the clip in home position;

FIG. 6A is a diagram of friction forces;

FIG. 7 is a detail side view showing the clip in home position;

FIGS. 8 and 9 are diagrams showing the forces involved under the present invention; and FIG. 10 is a diagram showing, for comparison, the forces involved in a known form of resilient rail fastener.

SUMMARY AND OBJECTS OF THE PRESENT INVENTION

Resilient fasteners as heretofore manufactured have embodied complicated and heavy-bodied configurations which are costly to manufacture and difficult to apply. With this in mind, together with the preceding disclosure, among the objects of the present invention are to construct the clip of uncomplicated geometry so that it may be easily stacked as in the magazine of a machine which can position and apply the clip automatically to the shoulder and thrust the clip to the operative position between the shoulder and rail, to so construct the clip that no heel reaction is involved, thereby eliminating the need for a shoulder having a shelf, and so configuring the shoulder and clip that more effective restraints than heretofore are achieved by unique forces. Further, because of the configuration, it is possible to employ a clip with a greater spring rate than heretofore possible.

The rail restraint achieved by the known resilient fasteners (the toe load) is simply the spring rate of the clip multiplied by the interference; by interference is meant the displacement of the effective spring arm to its applied or home position. More specifically, the toe load in the known construction is balanced by the shoulder reaction and the heel reaction. Vertical resistance to a rail lifting tendency is simply the spring rate multiplied by the lift distance plus interference. Lateral resistance is due almost entirely to friction produced by the toe load.

In the present fastener, by comparison, there is no heel reaction, and the toe load is a vector sum of the load produced by the interference and the shoulder reaction, that is, a summation of vertical and lateral forces not heretofore prevalent. This is achieved by wedging a generally flat U-shaped spring clip between the shoulder and rail base. There is no clip configuration requiring a shoulder with a seat or shelf to resist the heel force, and consequently less mass is involved. Further under the present invention, lateral movement and vertical uplift or tipping will be resisted more effectively because of the wedging action and considerable friction. Thus, the resistance produced by friction on the angled face of the shoulder will present considerably more opposition to lateral and vertical movement of the rail than known devices.

PREFERRED EMBODIMENT

The assembly, as installed, is shown in FIG. 1, except for the cross tie which may be concrete or wood, in which will be embedded the spike-like shank 10 of a pair of elongated shoulder members 12.

The rail R has a base 14 presenting a pair of sloped top surfaces 16; the head of the rail is joined to the base by a web, all of standard configuration. The underside of the rail base is flat of course, and sets on a tie pad 18 of known material.

The spring clip 20 featured in the present invention is generally a symmetrical, U-shaped, forged or otherwise formed clip of spring steel. More specifically, the spring clip, FIG. 3, has a pair of forwardly extending arms 24 from the bend forming the head 26 of the clip. The bight or head 26 of the clip is of uniform radius r, but is symmetrically bowed outwardly of the longitudinal center axes of the arms as will be apparent from FIG. 3. Thus, the outer diameter of the head of the spring clip exceeds the outside separation distance of the spaced spring arms 24. This large bend of uniform diameter taken in combination with the spring arms establish the spring rate (K) of the spring clip.

Referring again to FIG. 3, the inside faces at the free ends of the clip arms are tapered or bent outwardly to present a pair of prongs 24A to facilitate insertion as will be explained.

Inwardly (rearwardly) of the prongs, the inside faces of the arms are notched or undercut at 28 to present opposed fore and aft stops 28S and 28T. In the home position, the longitudinal width of the shoulder (in the neck area hereinafter defined) is embraced or clasped tightly between the detenting notches 28; the stops 28S and 28T, respectively, fit over the end faces of the shoulder member, that is, the end faces of the shoulder member that are at the ends of the detents or stops. These end faces of the shoulder member, in other words, are in planes perpendicular to the line of rail.

The shoulder members 12, FIG. 1, are located outwardly of the rail bases, and preferably, in each related area, the tie pad 18 is notched, if need be, to accommodate the shanks of the shoulders positioned closely to the rail flanges.

A non-metallic L-shaped insulator 32 (e.g. tough plastic) is so dimensioned as to have a long leg parallel to the line of and resting on the sloped upper face of the rail base, with the short leg neatly occupying the space between the outer edge of the flange and the opposed inside surface of the shoulder. The insulator is necessary for a rail which conducts current used for R.R. signals. However, the insulator may not always be necessary. It is not a feature of the invention, and it may be considered a shim or simply as an elevation of the rail base.

The spring clip as will readily be perceived has but a single bend, so to speak; namely, the bend of uniform radius representing the head 26. It is therefore to be distinguished from complicated, serpentine-shaped spring clips as heretofore proposed in which there are several bends projecting in different directions which make installation and stacking difficult. Further in this regard, the arms of the spring clip lie in the same plane PL, FIG. 4, and a longitudinal section line through the head would be parallel to and would lie in the same plane. Indeed, the clip is symmetrical throughout as can be perceived from the various (bisecting) center lines shown in FIGS. 3, 4 and 5. The upper and lower faces of the spring clip are of the same geometry, the outer surfaces are substantially flat throughout and the inner surfaces which clasp the neck of the anchor are of uniform convex radius so that either arm will fit the concave radius of recess 44. Thus, the spring clip has neither an obverse nor reverse position. Further, it can be applied to the shoulder from either direction, that is, applied in the line direction shown in FIG. 2 or reversed.

Each shoulder is topped off by a head 36 having a flat top sloped downwardly and away from the rail, FIG. 1. The shoulder head has an outwardly projecting ear 40, FIG. 6, and beneath this ear there is a narrowed neck 42 presenting an elongated concave recess or cavity 44 into which one arm of the spring clip may be inserted and captured with a press fit at the commencement of installation.

The inside surface of the shoulder facing the rail flange has a sloped or angled surface 45, sloped downwardly and inwardly toward the neck 42. The slope of this surface, when projected, defines, with the vertical, an included angle $\theta_1$ of about 23° for example. The space between the surface 45 of the shoulder and the insulator or shim presents a recess 47 for the other leg of the spring clip as can be readily visualized in FIG. 6. When the spring clip is installed, effectively clasping the shoulder member about its neck, it is cocked in a plane angled ($\theta_2$) to the horizontal surface of the tie because the two recesses 44 and 45 are displaced vertically along the vertical axis of the shoulder member. The lateral separation between the recesses may be termed the "interference" considered in terms of the separation distance between the inside faces of the spring arms which is considerably less, requiring the spring arms to spread apart by the difference (the interference distance) when the spring clip is driven home.

When the two arms of the spring clip are initially inserted and guided into the recesses thus provided, the foremost ends of the prongs 24A will be approximately at the mid-position M of the long axis of the shoulder, FIG. 7. Then, the clip may be forced to home position shown in FIGS. 2 and 7 where the cross-section of the shoulder member is captured entirely within the slot 28 of the spring clip, that is, the fore stops 28S and the aft stops 28T engage the opposed end faces of the shoulder under the head.

Refer now to FIG. 8 where the clip arms in home position are shown by circles 24' and 24'' to aid in depicting the effective force balances. One arm of the spring clip is captured in recess 44, the other arm bears against surface 45. The dashed circle denotes the position of the inside arm of the (undeformed, untensioned) spring clip prior to being driven home. The symbol d (delta) denotes the deformation or deflection of the inside arm, termed interference, when the spring clip has been driven to home position, denoted by the solid inside circle 24'. The clip load (CL) on the inside spring arm 24' is therefore Kd, the spring rate or constant (K) multiplied by the displacement d amounting to a measure of the clip interference in units of force.

The clip in home position is canted or cocked at an angle of about 28° to the horizontal ($\theta_2$) and is wedged between the angled surface 45 of the shoulder and the rail base. The shim of course is in effect part of the rail base. There is, therefore, a shoulder reaction SR and a toe reaction TR which may also be deemed the toe load TL. The clip load (CL) is Kd as already noted, and taking the slope of the upper surface of the rail base as 14°, we have:

$$TL = CL \sin \theta_2 + SR \sin \theta_1 \quad \text{(Eq. 1)}$$

$$TL \tan 14° = SR \cos \theta_1 - CL \cos \theta_2 \quad \text{(Eq. 2).}$$

Solving (Eq. 1) and (Eq. 2) gives:

$$TL = CL \times \frac{(\sin \theta_2 + \cos \theta_2 \tan \theta_1)}{1 - \tan (14°) \tan \theta_1} . \quad \text{(Eq. 3)}$$

Lateral movement will be resisted by the shoulder reaction because of the wedging and the friction (f) which is considerable.

Resistance to rail uplift, FIG. 9, is a complex equation.

In further consideration of resistance to uplift, the change in interference is $(L_2-L_1)$ where $L_2$ equals, (Eq. 4):

$$L_2=[L_1 \cos \theta_2+\Delta \tan \theta_1)^2+(L_1 \sin \theta_2+\Delta)^2]^{\frac{1}{2}}$$

The change in clip load (Kd) is then $$CL=K\times(L_2-L_1) \quad \text{(Eq. 5)}$$

The change in toe load can be found from Eq. 3. The total toe load is the change plus the original load.

The effect of friction on resistance to uplift/tipping is considerable. The force diagrams on the clip arm are presented in FIG. 6A, FIG. 6 being the model, where $f_s=\mu SR$ and $f_t=\mu TR$.

Summing the forces in the vertical and lateral directions:

$$CL \sin \theta_2+TR(\mu \sin 14^\circ-\cos 14^\circ)+SR(\mu\cos \theta_1+\sin \theta_1)=0 \quad \text{(Eq. 6)}$$

and $$CL \text{ `}\cos \theta_2+TR\text{`}(\mu \cos 14^\circ+\sin 14^\circ)+SR(\mu \sin \theta_1-\cos \theta_1)=0 \quad \text{(Eq. 7)}$$

Solving simultaneously for TL, that is, $$TL=TR\cos 14^\circ \quad \text{(Eq. 8)}$$

we have $$TL = CL \times \frac{\sin \theta_2 - C_1 \cos \theta_2}{C_1 (\tan 14^\circ + \mu) - \mu \tan 14^\circ + 1} \quad \text{(Eq. 9)}$$

where $$C_1=(\mu \cos \theta_1+\sin \theta_1)/(\mu \sin \theta_1-\cos \theta_1)$$

In an instance where $\theta_1=23^\circ$ and $\theta_2=28^\circ$ with $\mu=0$, $$TL=0.944CL$$

but where $\mu=0.2$, typical of the metallurgy involved, $$TL=1.67CL$$

which is an increase of 77%.

The present construction as thus analyzed may be compared to forces involved with the multi-bend spring clip of the prior art (e.g. U.S. Pat. Nos. 4,405,081, 4,715,534 and 4,801,084) which usually involves arms or bends in the spring producing a toe load, a heel reaction, and a shoulder reaction, FIG. 10. Here, the toe load is simply the spring rate multiplied by the interference, Kd, balanced by the shoulder and heel reaction, that is, $$\text{Heel reaction}=B/A(Kd) \quad \text{(Eq. 10)}$$

and $$\text{Shoulder reaction}=(Kd)+\text{Heel reaction} \quad \text{(Eq. 11)}$$

Further, the vertical resistance in the known arrangement, FIG. 10, is simply the spring rate multiplied by the vertical uplift, that is $K\Delta$ plus the original toe load.

It will be recognized from the foregoing that the essential resistances to longitudinal, lateral and vertical movement of the rail are achieved by a one-piece clip of uncomplicated geometry, cocked at an angle to the horizontal, in combination with the angled surface of the shoulder by which any need for a heel reaction geometry is eliminated.

When the clip is applied, the arms are spread by the interference distance. This spread (d) taken with the spring rate is the clip load Kd. The clip and opposed surfaces of the shoulder are so configured that when the clip is installed with its arms embracing the shoulder, it is cocked (under load) at an acute angle to the horizontal, angle $\theta_2$. The opposed surfaces are the recess 44 in which one arm of the clip seats and the angled face 45, FIG. 6, against which the other arm of the spring clip bears.

Since one arm of the spring clip and the opposed reaction surface 45 engage one another at an angle $\theta_1$ there is a component of the shoulder reaction at surface 45 contributing to the toe load. This toe load is the vector sum of the clip load (at $\theta_2$) and the shoulder reaction (at $\theta_1$) manifest in a downward force on the rail base.

The angles $\theta_1$ and $\theta_2$ can be varied somewhat in concert with the rate of the spring clip. Of course for manufacturing purposes the values should be a constant; hence I postulate an angle $\theta_1$ somewhere in the range 5°/25°, and $\theta_2$ somewhere in the range of 20°/45°. The variations are infinite, especially in light of the fact that the shim itself need not be at a similar angle (14°) to that of the rail base, but itself may be increased or decreased within practical limits further to enlarge the manufacturing tolerances.

I claim:

1. In a resilient rail fastener system where a rail supported by a cross tie is to be secured against movement by a spring clip applying forces to the rail, said spring clip to be applied to a shoulder member embedded in the tie:

a generally U-shaped one-piece spring clip having a rounded head of predetermined radius and a pair of spaced apart symmetrical arms extending forwardly therefrom to be spread apart by an interference distance when driving the clip to home position between the rail and shoulder member, and the outside diameter of the head along with said arms establishing a predetermined spring rate for the clip;

said spring clip, including the head and arms, being symmetrical about a longitudinal axis between the arms and symmetrical about a horizontal plane bisecting the head and arms;

a one-piece spike-like shoulder member having a shank portion to be embedded in the cross tie, said shoulder member having an exposed neck when the shank is embedded and an exposed head above the neck;

said neck on one side having a recess into which one arm of the clip is to fit and said neck on the opposite side presenting a sloped reaction surface angled downwardly and inwardly from the head to define a wedging recess for the other clip arm, said recesses being vertically displaced along the vertical axis of the shoulder member so that upon insertion of the arms into said recesses to clasp said neck the clip is cocked into a plane angled with respect to the horizontal;

said arms in the uninstalled state of the spring clip being separated by a distance less than the lateral distance separating said recesses so that said arms are spread apart by a corresponding interference distance when the clip is advanced to home position thereby creating a load on the spring clip;

and said other arm of the spring clip when installed creating a shoulder reaction at said reaction surface so that the spring clip when installed has a toe load impressed thereon which is a vector sum of the clip load and shoulder reaction applying a downward force to the rail.

2. Rail fastener system according to claim 1 in which the inside surfaces of the spring arms which clasp the shoulder member are rounded convexly and in which the first-named recess in the shoulder has a complementary concave radius.

3. Rail fastener system according claim 1 in which the slope of the reaction surface defines an included angle of about 23° with the vertical, and wherein the angle of the locked plane is about 28° to the horizontal.

4. Resilient railroad fastener system comprising an elongated shoulder member to be embedded in a tie supporting a rail, and spring clip to be so applied and combined with the shoulder member as to create a toe load applied downward to the rail, and comprising:

a symmetrical spring clip presenting a pair of spaced arms for embracing and clasping opposite sides of the shoulder member when applied thereto, and said arms being joined by a bend establishing a spring rate for the clip;

said shoulder member having a reaction surface on one side to be engaged at a first angle $\theta_1$ by one arm of the applied spring clip resulting in a shoulder reaction at said reaction surface;

said shoulder member on the other side being configured with a capturing surface to capture the other spring arm while cocking the spring clip at an angle $\theta_2$ to the horizontal when the spring clip is applied to the shoulder member;

and said spring arms being spread apart by a distance less than the distance separating the reaction surface and capturing surface of the shoulder member so that when applied the spring arms are spread to create a clip load, whereby when installed the spring clip has a toe load impressed thereon which is the vector sum of the clip load and shoulder reaction wherein angle $\theta_1$ is in the range of about 5°–25° and angle $\theta_2$ is in the range of about 20°–45°.

* * * * *